US006161317A

United States Patent [19]

Wang

[11] Patent Number: 6,161,317

[45] Date of Patent: Dec. 19, 2000

[54] DECORATIVE AMUSEMENT DEVICE

[75] Inventor: Shou-I Wang, Taipei, Taiwan

[73] Assignee: Chih Chuag X'Mas Decoration Factory, Bao An, China

[21] Appl. No.: 09/394,586

[22] Filed: Sep. 13, 1999

[51] Int. Cl.[7] ..... G09F 19/00

[52] U.S. Cl. ..... 40/406; 40/410

[58] Field of Search ..... 40/406, 409, 410, 40/411, 429, 430, 440; 446/267

[56] References Cited

U.S. PATENT DOCUMENTS

| | | | |
|---|---|---|---|
| 4,817,311 | 4/1989 | Ong | 40/410 |
| 5,272,604 | 12/1993 | Lin | 40/409 |
| 5,313,727 | 5/1994 | Murray, Jr. | 40/410 |
| 5,711,099 | 1/1998 | Nesbit et al. | 40/406 |
| 5,864,976 | 2/1999 | Yang | 40/410 |

*Primary Examiner*—Cassandra H. Davis
*Attorney, Agent, or Firm*—Merchant & Gould P.C.

[57] ABSTRACT

A decorative amusement device includes a transparent sphere that is mounted on and that cooperates with a base to confine a water receiving space to be filled with water. A drive unit is mounted inside the base, and has a rotary drive shaft extending through the base into the water receiving space, and a water agitator mounted on the drive shaft inside the water receiving space. A decorative member is mounted on the base inside the water receiving space, and includes a prop, a rotary vane mounted rotatably on the prop, and a guide member disposed around the water agitator so as to guide the water that was agitated by the water agitator toward the rotary vane to result in rotation of the rotary vane inside the water receiving space when the drive shaft rotates.

6 Claims, 6 Drawing Sheets

DECORATIVE AMUSEMENT DEVICE

FIELD OF THE INVENTION

The invention relates to an amusement device, more particularly to an amusement device which has a transparent water filled sphere provided with a movable decorative member therein to simulate an attractive scene or landscape, thereby providing aesthetic effects to the user.

BACKGROUND OF THE INVENTION

Referring to FIG. 1, a conventional decorative amusement device 1 is shown to include a base 11, a transparent sphere 12 that is mounted on the base 11 and that cooperates therewith so as to confine a water receiving space 121 to be filled with water, and a drive unit 13 mounted inside the base 11. The drive unit 13 includes a motor 131 with a rotary drive shaft 130 that extends through the base 11 and into the water receiving space 121. A water agitator 133 is mounted on the drive shaft 130 inside the water receiving space 121, and is driven rotatably by the drive shaft 130 to agitate the water inside the water receiving space 121, thereby causing the water and glittering specks to circulate inside the water receiving space 121 in order to provide an aesthetic effect.

A disadvantage of the aforesaid conventional decorative amusement device resides in that no movable objects are mounted inside the water receiving space 121. The water circulation by itself will eventually provide a monotonous feeling upon long term use of the conventional device.

SUMMARY OF THE INVENTION

Therefore, the object of this invention is to provide a decorative amusement device which has a transparent water filled sphere provided with a movable decorative member therein to simulate an attractive scene or landscape, thereby providing aesthetic effects to the user.

Accordingly, the decorative amusement device of the present invention includes a hollow base, a transparent sphere, a drive unit, and a decorative member. The transparent sphere is mounted on the base and cooperates therewith to confine a water receiving space that is adapted to be filled with water. The drive unit is mounted inside the base, and has a rotary drive shaft extending through the base and into the water receiving space, and a water agitator mounted on the drive shaft inside the water receiving space. The water agitator is driven rotatably by the drive shaft to agitate the water inside the water receiving space when the drive shaft rotates. The decorative member is mounted on the base inside the water receiving space, and includes a prop, a rotary vane mounted rotatably on the prop, and a guide member disposed around the water agitator so as to guide the water that was agitated by the water agitator toward the rotary vane to result in rotation of the rotary vane inside the water receiving space.

Preferably, the decorative member includes a hollow platform mounted on a top wall of the base and formed with an opening that is registered with the water agitator. The prop and the guide member are disposed on the platform.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 1:
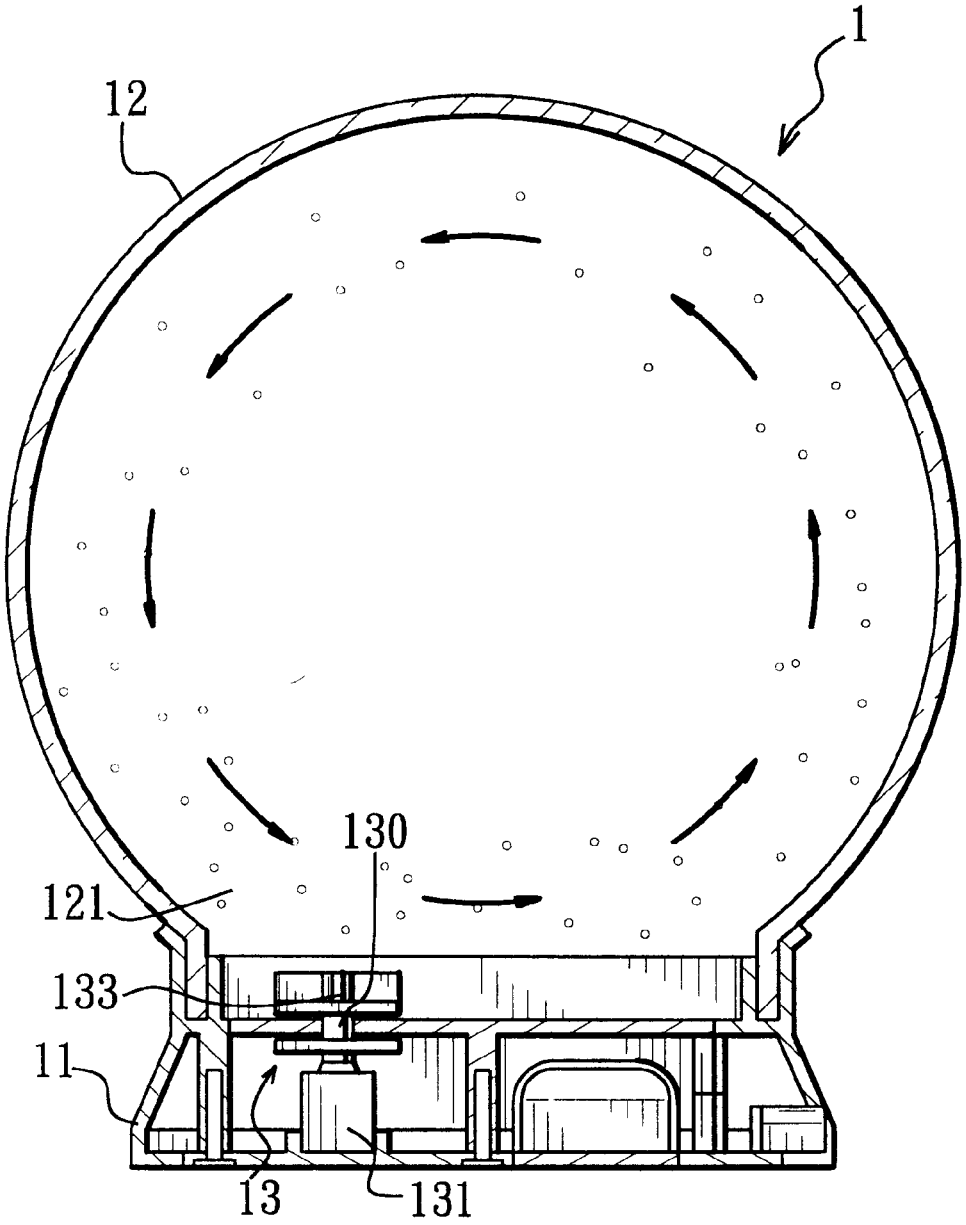
F I G. 1 PRIOR ART
FIG. 1 illustrates a conventional decorative amusement device in a state of use.
Figure 2:
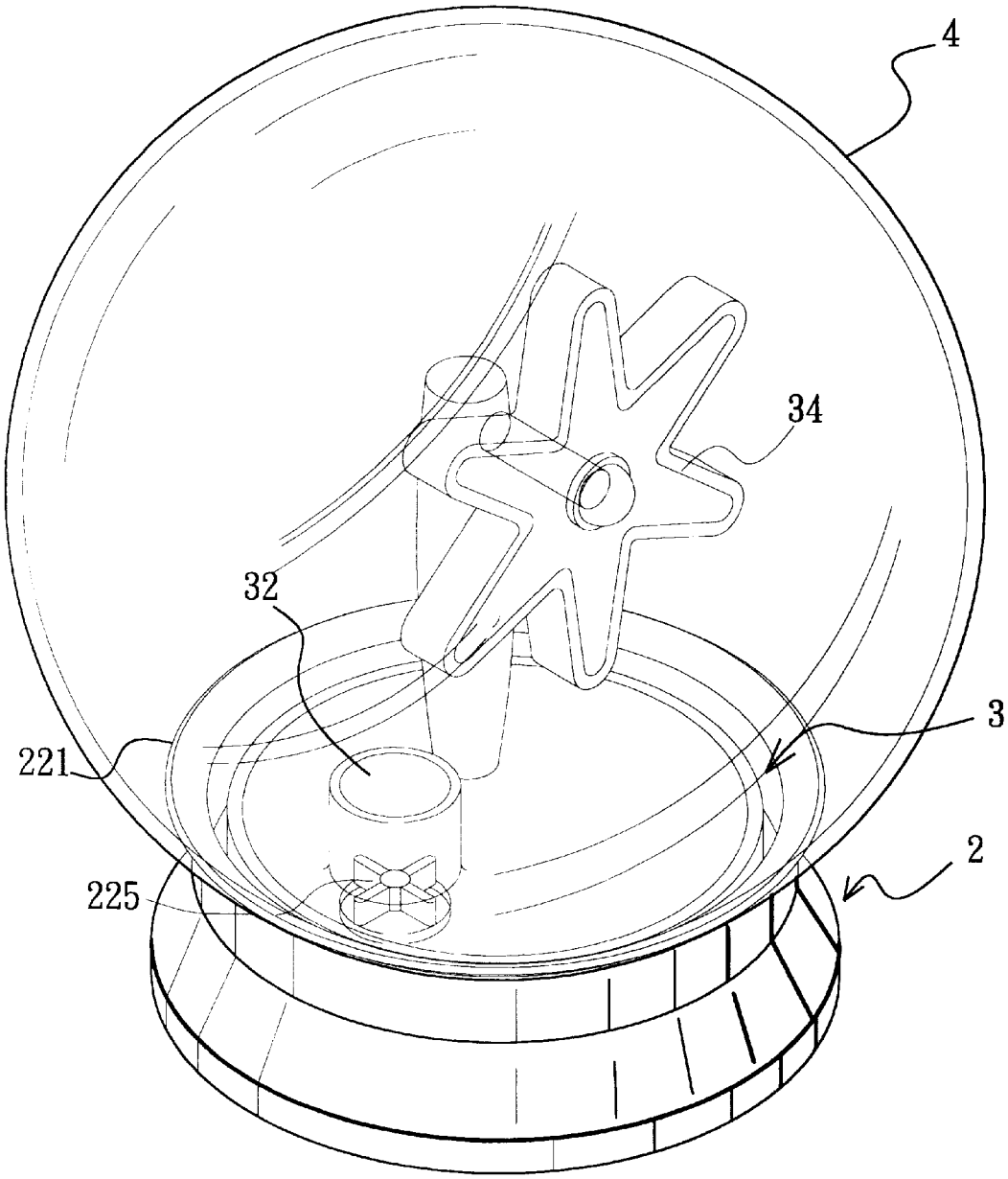
FIG. 2 is a schematic and perspective view of the preferred embodiment of a decorative amusement device of the present invention.
Figure 3:
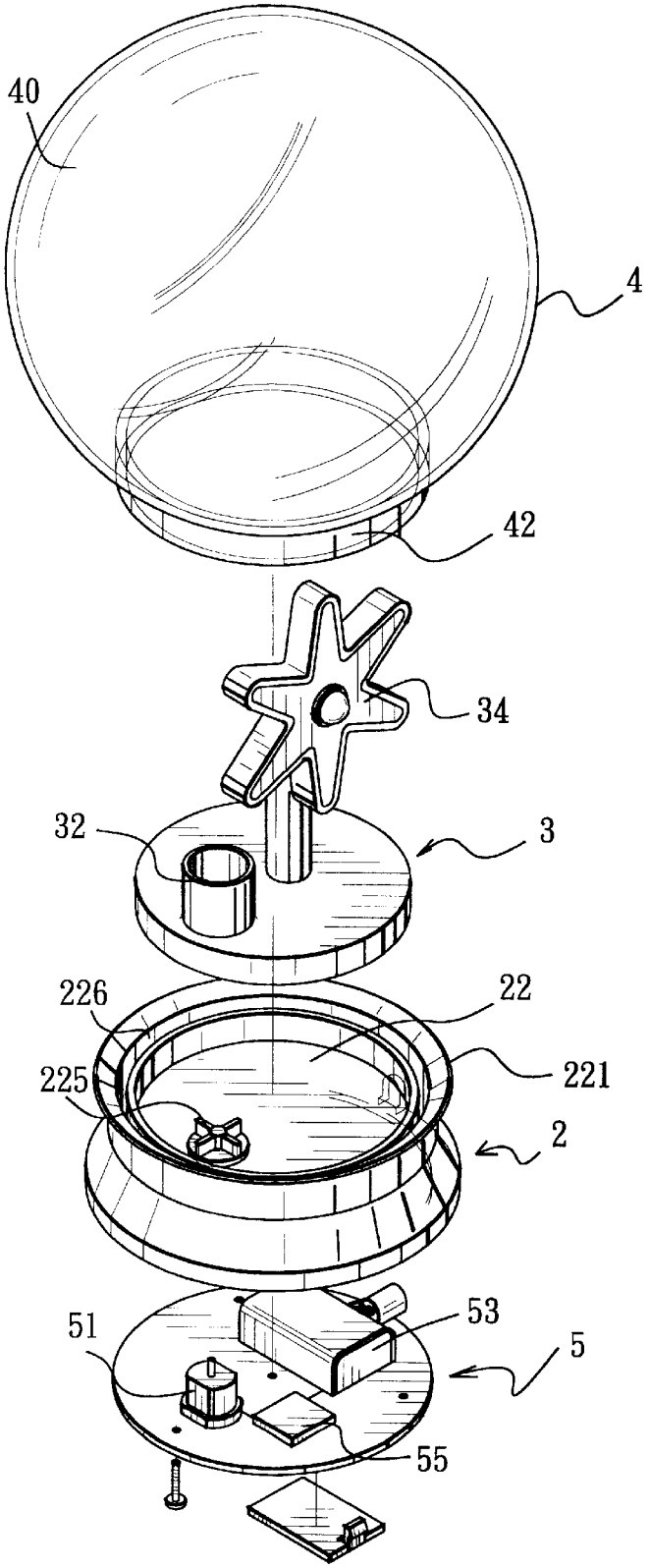
FIG. 3 is an exploded perspective view of the preferred embodiment.
Figure 4:
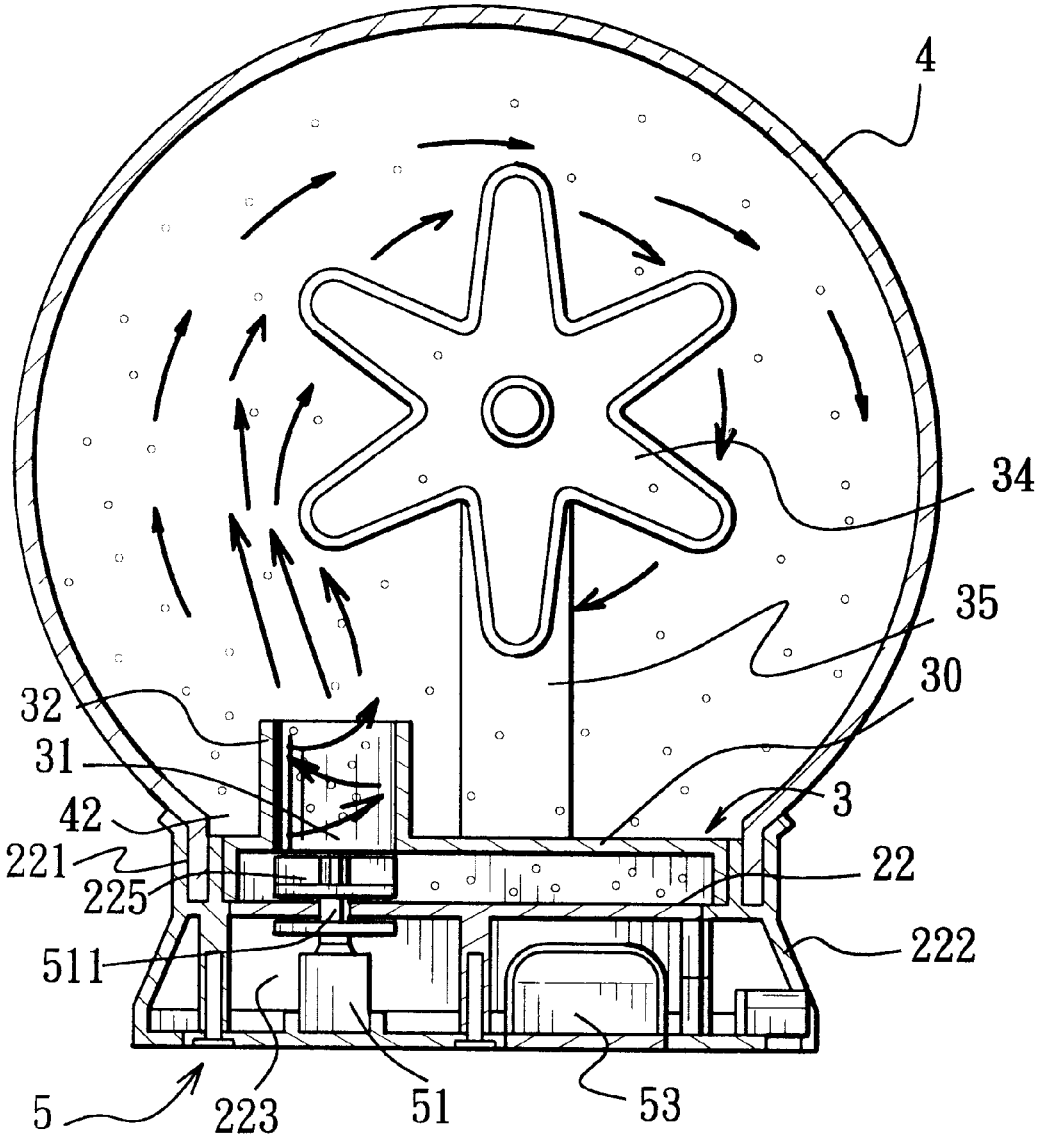
FIG. 4 illustrates the preferred embodiment in a state of use.

Referring to FIGS. 2 to 4, the preferred embodiment of a decorative amusement device of the present invention is shown to include a hollow base 2, a transparent sphere 4, a drive unit 51, and a decorative member 3.

As illustrated, the base 2 includes a top wall 22, a surrounding wall 222 that extends downwardly from a periphery of the top wall 22 to define a lower compartment 223 below the top wall 22, and a sphere retaining wall 221 that extends upwardly from the periphery of the top wall 22. The sphere retaining wall 221 is formed with a rim engaging groove 226 therealong.

The transparent sphere 4 has a lower open bottom end with a rim 42 that engages fittingly and sealingly the rim engaging groove 226 of the sphere retaining wall 221. The transparent sphere 4 cooperates with the base 2 to confine a water receiving space 40 that is adapted to be filled with water.

The drive unit 51, preferably a motor, is mounted in the lower compartment 223 of the base 2, and has a rotary drive shaft 511 extending through the top wall 22 and into the water receiving space 40, and a water agitator 225 mounted on the drive shaft 511 inside the water receiving space 40. The water agitator 225 is driven rotatably by the drive shaft 511 to agitate the water inside the water receiving space 40 when the drive shaft 511 rotates. A battery unit 53 is disposed in the lower compartment 223 and is electrically connected to the drive unit 51 so as to supply electrical power thereto. A control circuit 55 is provided in the lower compartment 223 and is connected electrically to the drive unit 51 for controlling the operation of the same. The control circuit 55 may incorporate music generating function for enhancing consumer appeal. Since the detailed construction of the control circuit 55 is not critical to this invention, a detailed description of the same will be omitted herein for the sake of brevity. The lower compartment 223 is closed by a bottom cover 5 to facilitate replacement of the battery unit 53.

The decorative member 3 is disposed in the water receiving space 40, and includes a hollow platform 30, an upright prop 35, a rotary vane 34, and a guide member 32. The platform 30 is mounted on the top wall 22 of the base 2 and is formed with an opening 31 that is registered with the water agitator 225. The prop 35 is mounted uprightly on the platform 30 adjacent to the opening 31. The rotary vane 34 is mounted rotatably on the prop 35. In this embodiment, the prop 35 and the rotary vane 34 cooperatively have an appearance in the form of a simulated windmill. Alternatively, the prop 35 and the rotary vane 34 can be designed to have an appearance in the form of a simulated water mill. The guide member 32 is also mounted on the platform 30 around the opening 31 thereof so as to be registered with the water agitator 225. Preferably, the guide member 32 is formed as an upright tube that extends upwardly from the periphery of the opening 31 such that a distal upper end thereof is disposed underneath the rotary vane 34. Under this condition, when the drive unit 51 is activated, the water around the water agitator 225 will be agitated so as to be guided toward the rotary vane 34 to result in rotation of the rotary vane 34 inside the water receiving space 40.

Glittering or snow specks can be disposed in the water receiving space 40 such that movement of the water inside the water receiving space 40 will result in corresponding movement of the specks to provide additional amusement.

Figure 5:
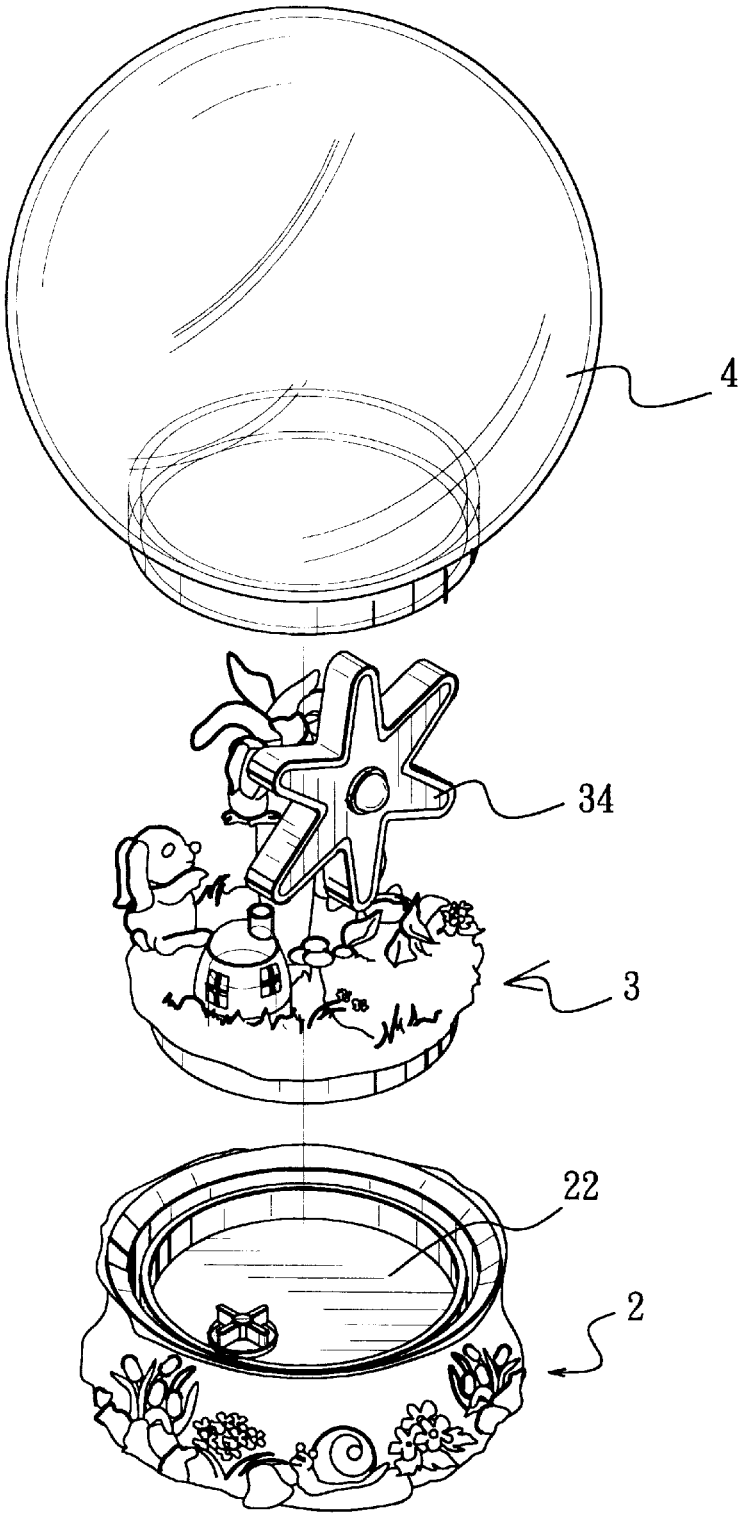
FIG. 5 is an exploded perspective view of a modified preferred embodiment of the present invention.
Figure 6:
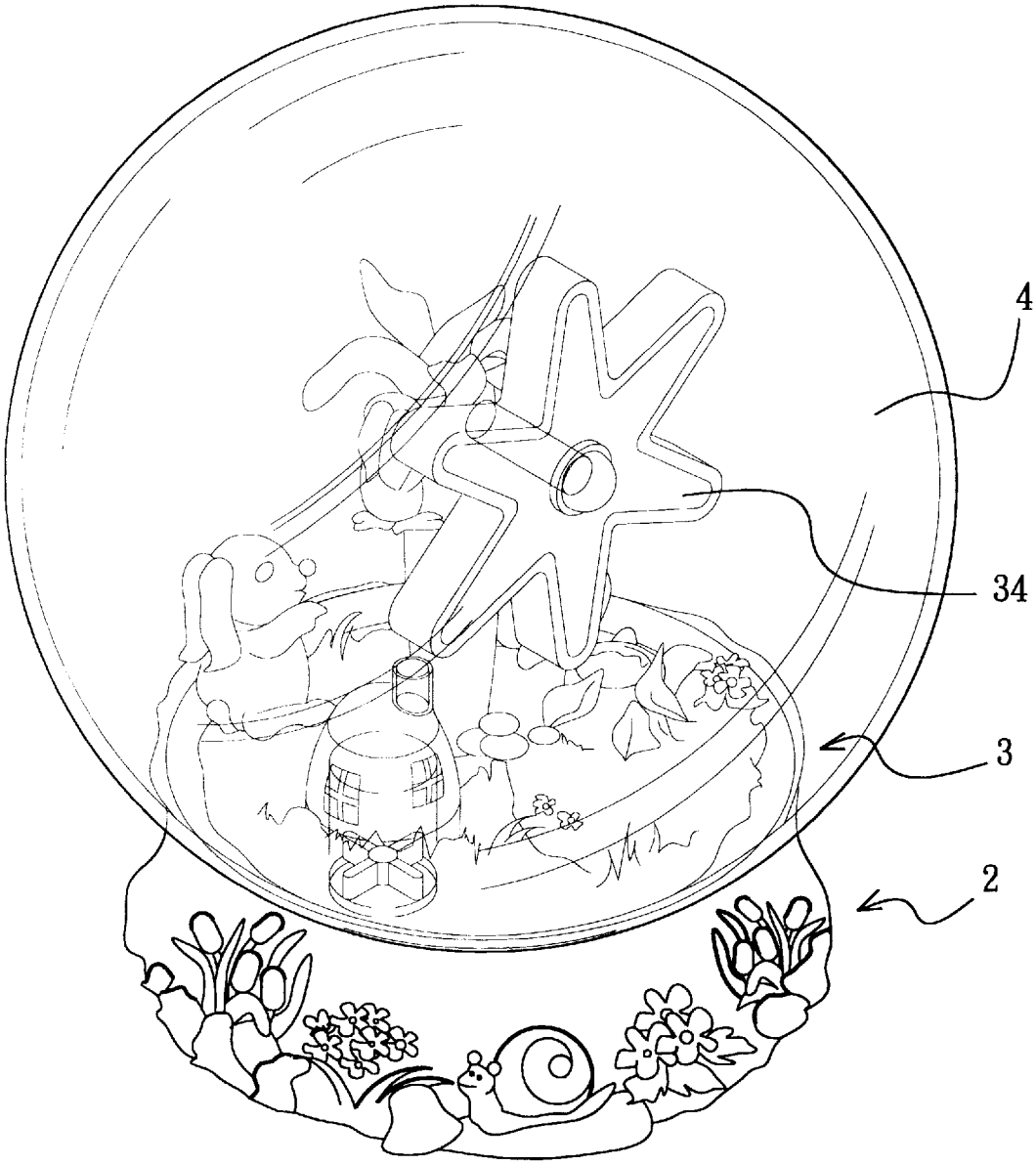
FIG. 6 is an assembled perspective view of the modified preferred embodiment.

Referring to FIGS. 5 and 6, the platform of the decorative member 3 can be designed to simulate a scene or view to further enhance the consumer appeal of the amusement device of this invention.

With this invention thus explained, it is apparent that numerous modifications and variations can be made without departing from the scope and spirit of this invention. It is therefore intended that this invention be limited only as indicated in the appended claims.

I claim:

1. A decorative amusement device comprising:

a hollow base;

a transparent sphere mounted on said base and cooperating therewith so as to confine a water receiving space that is adapted to be filled with water;

a drive unit mounted inside said base and having a rotary drive shaft extending through said base into said water receiving space, and a water agitator mounted on said drive shaft inside said water receiving space and driven rotatably by said drive shaft to agitate the water inside said water receiving space when said drive shaft rotates; and a decorative member mounted on said base inside said water receiving space, said decorative member including a prop, a rotary vane mounted rotatably on said prop, and a guide member disposed around said water agitator so as to guide the water that was agitated by said water agitator toward said rotary vane to result in rotation of said rotary vane inside said water receiving space.

2. The decorative amusement device as defined in claim 1, wherein said base includes a top wall, a surrounding wall that extends downwardly from a periphery of said top wall, and a sphere retaining wall that extends upwardly from the periphery of said top wall, said sphere retaining wall being formed with a rim engaging groove therealong.

3. The decorative amusement device as defined in claim 1, wherein said transparent sphere has an open bottom end with a rim that engages fittingly and sealingly said rim engaging groove.

4. The decorative amusement device as defined in claim 3, wherein said decorative member further includes a hollow platform mounted on said top wall of said base and formed with an opening that is registered with said water agitator, said prop and said guide member being disposed on said platform.

5. The decorative amusement device as defined in claim 4, wherein said guide member is formed as an upright tube that is disposed on said platform at said opening.

6. The decorative amusement device as defined in claim 1, wherein said prop and said rotary vane cooperatively have an appearance in the form of a simulated windmill.

* * * * *